US011061356B1

(12) United States Patent
Noda

(10) Patent No.: US 11,061,356 B1
(45) Date of Patent: Jul. 13, 2021

(54) CONVEYANCE DEVICE

(71) Applicant: BROTHER KOGYO KABUSHIKI KAISHA, Nagoya (JP)

(72) Inventor: Kengo Noda, Inazawa (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/953,906

(22) Filed: Nov. 20, 2020

(30) Foreign Application Priority Data

Dec. 24, 2019 (JP) ..... JP2019-232982

(51) Int. Cl.
*G03G 21/00* (2006.01)
*G03G 21/16* (2006.01)

(52) U.S. Cl.
CPC ..... *G03G 21/1633* (2013.01); *G03G 21/1638* (2013.01); *G03G 2221/1678* (2013.01)

(58) Field of Classification Search
CPC ..... G03G 21/1623; G03G 21/1633; G03G 21/1638; G03G 21/1842; G03G 2221/1678
See application file for complete search history.

(56) References Cited

U.S. PATENT DOCUMENTS

2017/0355542 A1* 12/2017 Shima ..... B41J 11/006
2019/0137912 A1* 5/2019 Kasama ..... G03G 21/1633

FOREIGN PATENT DOCUMENTS

JP 2016-133708 A 7/2016

* cited by examiner

*Primary Examiner* — Hoang X Ngo
(74) *Attorney, Agent, or Firm* — Merchant & Gould P.C.

(57) ABSTRACT

A cover stopper engages a cover engaging portion when a cover is located at a closed position and to restrict rotational movement of the cover toward an open position. A rotation guide contacts, from above, a rib engagement surface during rotational movement of the cover and to guide rotational movement of the cover between the open position and a relay position. An urging member urges the cover from the relay position toward the closed position. When the cover rotationally moves from the open position to the relay position, a rib and the rotation guide engage each other to restrict upward movement of the cover against urging force of the urging member. When the cover reaches the relay position from the open position, the rib and the rotation guide become disengaged and the cover moves to the closed position where the cover engaging portion and the cover stopper engage each other.

19 Claims, 13 Drawing Sheets

CONVEYANCE DEVICE

CROSS REFERENCE TO RELATED APPLICATIONS

This application claims priority from Japanese Patent Application No. 2019-232982 filed Dec. 24, 2019. The entire content of the priority application is incorporated herein by reference.

TECHNICAL FIELD

This disclosure relates to a conveyance device.

BACKGROUND

Conventionally, a rear cover is provided on the rear side of an inkjet printer to form a part of a conveyance path for conveying sheets fed from a paper feed roller. The rear cover is configured to be movable between a closed position for defining the conveyance path and an open position for opening the conveyance path so that a user can access a sheet for fixing a jam.

SUMMARY

According to one aspect, this specification discloses a conveyance device. The conveyance device includes a cover, a cover stopper, a rotation guide, and an urging member. The cover includes a cover main body, a rotation shaft, a cover engaging portion, and a rib. The cover main body has a base end and an opposite end opposite the base end. The rotation shaft is provided at the base end of the cover main body. The cover is configured to move between a closed position at which the cover covers a conveyance path of a sheet and a relay position below the closed position. The cover at the closed position defines a part of the conveyance path. The cover is further configured to rotationally move about the rotation shaft between the relay position and an open position at which the cover opens the conveyance path to outside. The cover engaging portion is provided at the opposite end of the cover main body. The rib is provided closer to the base end than the cover engaging portion is. The rib has a rib engagement surface having an arc shape with a center at the rotation shaft. The cover stopper is configured to engage the cover engaging portion when the cover is located at the closed position and to restrict rotational movement of the cover toward the open position. The rotation guide is configured to contact, from above, the rib engagement surface during rotational movement of the cover and to guide rotational movement of the cover between the open position and the relay position. The urging member is configured to urge the cover from the relay position toward the closed position. The conveyance device is configured such that: when the cover rotationally moves from the open position to the relay position, the rib and the rotation guide engage each other to restrict upward movement of the cover against an urging force of the urging member; and when the cover reaches the relay position from the open position, the rib and the rotation guide become disengaged and the cover moves to the closed position where the cover engaging portion and the cover stopper engage each other.

BRIEF DESCRIPTION OF THE DRAWINGS

Embodiments in accordance with this disclosure will be described in detail with reference to the following figures wherein.

DETAILED DESCRIPTION

Figure 1:
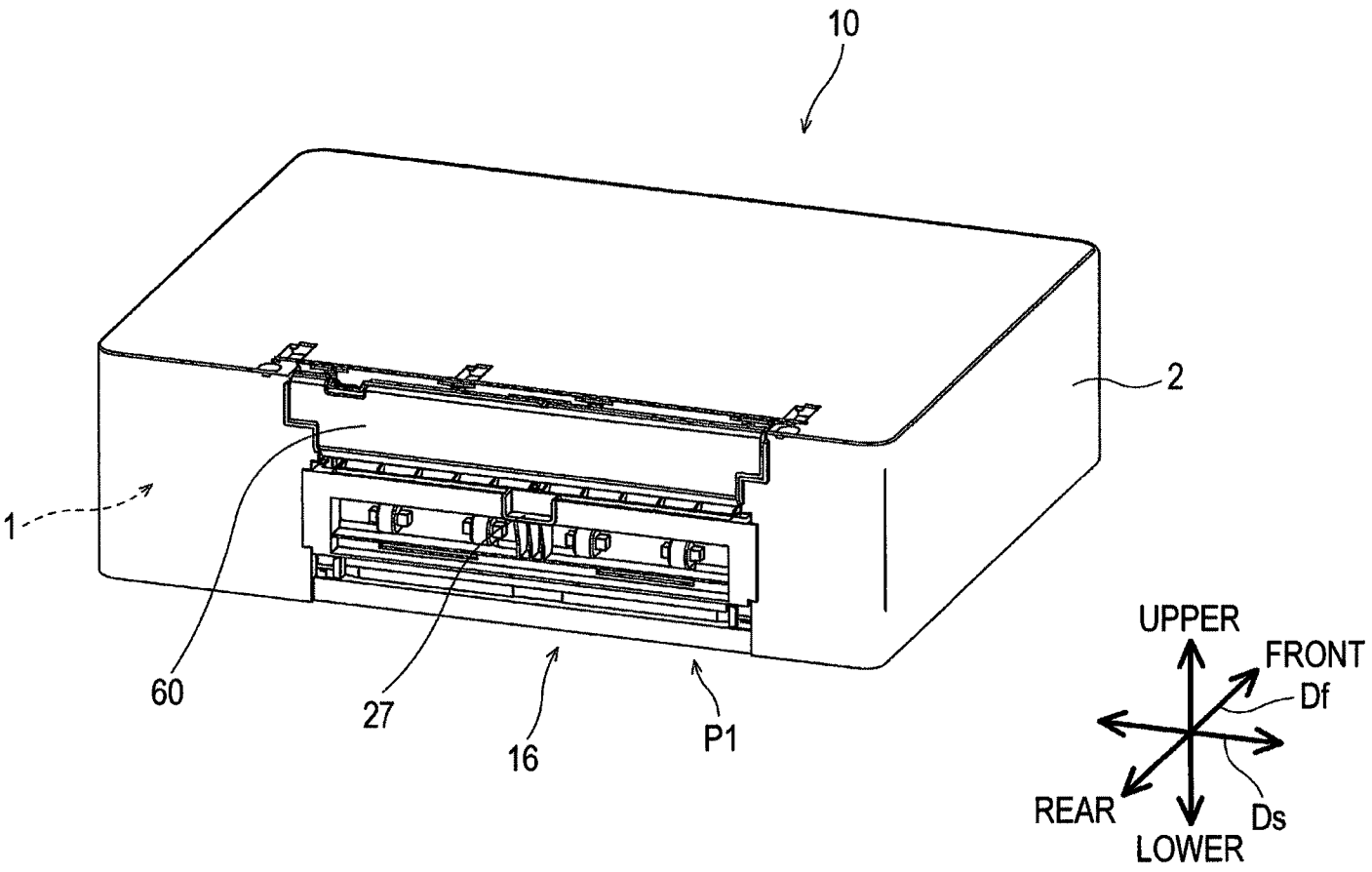
FIG. 1 is a perspective view of an image recording apparatus including a conveyance device according to an embodiment of this disclosure.

In the above-described printer, since the rear cover defines the conveyance path, the rear cover receives a force from the sheet conveyed along the conveyance path. At this time, the force received from the sheet is the force that urges the rear cover from the closed position to the open position. Therefore, it is necessary to hold the rear cover in the closed position so that the rear cover does not move to the open position due to the force received from the sheet. On the other hand, during a jam, the user generally manually operates the rear cover to move the same from the closed position to the open position. Thus, it is also important to ensure high operability so that the user can move the rear cover from the closed position to the open position without applying a large force.

For example, a known apparatus uses, as the locking mechanism for a rear cover, a protrusion-shaped engaged portion provided on the rear cover and a rod-shaped engaging portion provided on the main body of the apparatus and engaged with the engaged portion. In this configuration, when the rear cover is closed, the rear cover is locked by engagement of the engaged portion and the engaging portion, and the engaged portion is urged in the engaging direction by an urging member. In order to open the rear cover, the user operates a lever member to rotate the engaged member in the direction opposite the engaging direction against the urging force of the urging member to release the lock.

Here, the force that the rear cover receives from paper as a conveyance load includes a component that is opposite from the urging direction of the urging member, that is, the direction for releasing the lock. Thus, in order to lock securely, it is necessary to increase the urging force of the urging member, which is the lock load. However, if the urging force is increased, the operating load of the user at the time of releasing the lock becomes large, which worsens the operability. In this way, the lock performance and the operability are in a trade-off relationship with each other, and it is desirable to have a configuration in which both the lock performance and the operability have suitable performance at the same time. Thus, in order to achieve both good locking performance and good operability, it is conceivable that the urging direction for urging the rear cover to the closed position is an upward direction which does not include the direction of the force received by the rear cover from the paper. With this configuration, it is possible to reduce the influence of the conveyance load on the urging force during locking, and it is possible to suppress an increase in the operating load at the time of releasing the lock while ensuring sufficient locking performance.

In the configuration in which the rear cover is urged to the closed position in the upward direction that does not include the direction of the force that the rear cover receives from the paper, the lock is achieved by engagement of a claw provided at the upper end of the rear cover with an engaging portion of the apparatus main body. When the rear cover is changed from the closed state to the open state, the rear cover is once pushed down to disengage the engagement, and the rear cover is rotated in the opening direction in that state. However, since the rear cover is always urged upward, there is a risk that the claw is caught by the engaging portion when the rear cover is returned from the open state to the closed state, resulting in a half-closed state. In this case, in order to reliably return the rear cover to the closed state, the user need to return the rear cover while pushing the rear cover downward so that the claw portion gets over the engaging portion. If the amount of pushing is insufficient, it becomes a half-closed state, which leaves a problem in operability.

In view of the foregoing, an aspect of an objective of this disclosure is to provide a conveyance device that improves operability of a user when a cover is moved from an open state to a closed state and that suppresses a half-closed state.

Hereinafter, a conveyance device according to an embodiment of the present disclosure will be described with reference to the drawings. The conveyance device is applied to an image recording apparatus such as an inkjet printer. The conveyance device described below is only one embodiment of the present disclosure. Therefore, the present disclosure is not limited to the following embodiment, and additions, deletions, and changes may be made without departing from the spirit of the present disclosure.

In the following description, an inkjet printer will be described as an example of an image recording apparatus, but the image recording apparatus is not limited to this, and may be another printer such as a laser printer or a thermal printer.

As shown in FIG. 1, an image recording apparatus 10 to which a conveyance device 1 of the present embodiment is applied includes a rectangular-parallelepiped shaped housing 2, for example. A part of the elements of the conveyance device 1 and a printing unit are provided within the housing 2, and the other part is provided to be exposed to the outside. A scanner unit may be provided on the housing 2.

Figure 2:
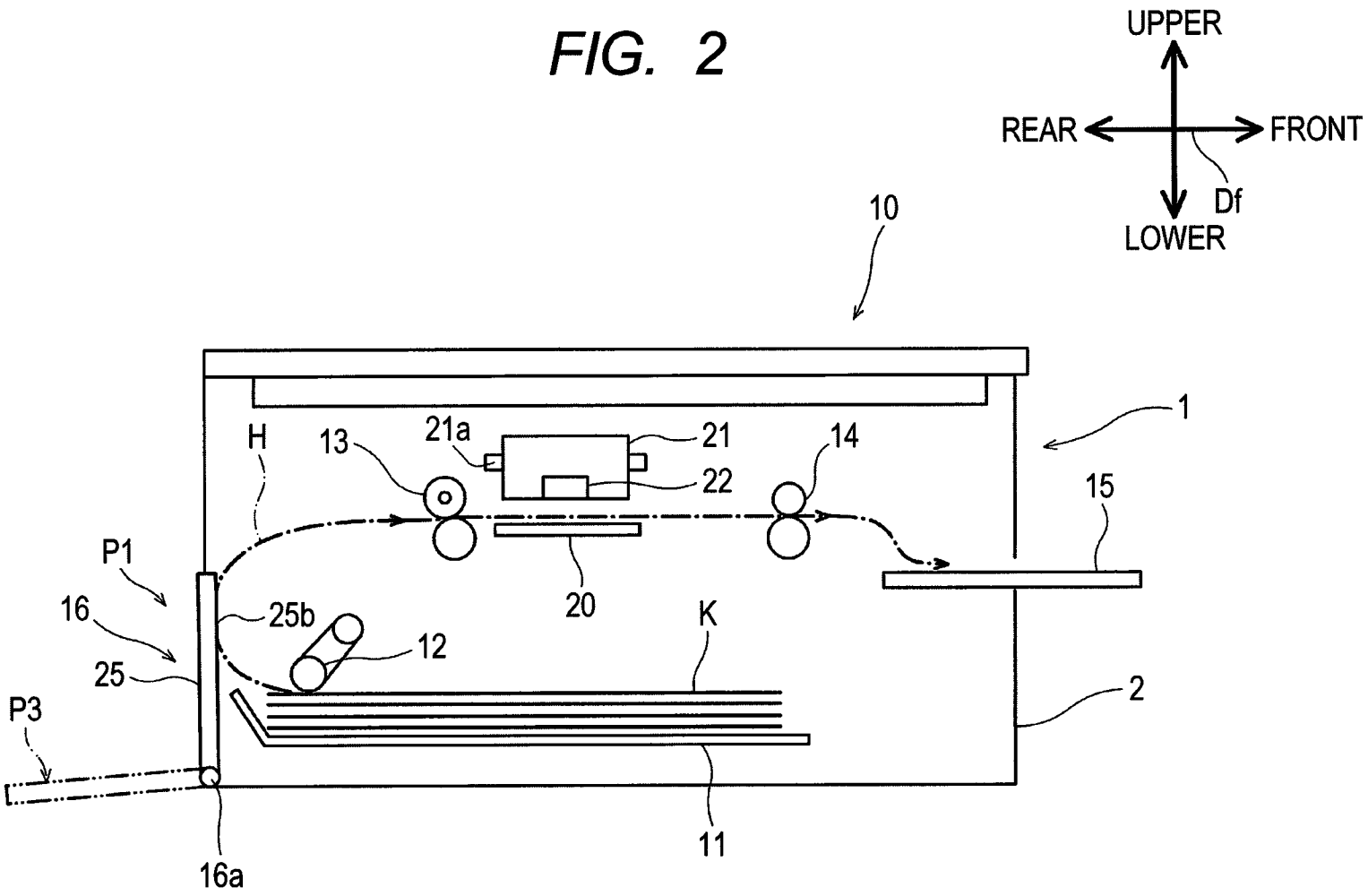
FIG. 2 is a schematic diagram showing the configuration of the conveyance device of the image recording apparatus shown in FIG. 1.

As shown in FIG. 2, the conveyance device 1 of the present embodiment includes an accommodating portion (paper feed tray) 11 for accommodating a sheet (recording medium) K, a paper feed roller 12, a conveyance roller 13, and a discharge roller 14, a discharge tray 15, and a cover 16. In the housing 2, a conveyance path H is formed from the accommodating portion 11 to the discharge tray 15 and is curved rearward and upward from the accommodating portion 11. The cover 16 may also be referred to as a rear cover or a shoot cover.

The conveyance roller 13 is arranged downstream of the cover 16 in the conveyance direction. The accommodating portion 11 is arranged at the lower part in the housing 2. The sheet K accommodated in the accommodating portion 11 is conveyed by the paper feed roller 12 toward the conveyance roller 13 via the inner surface of the cover 16. The sheet K is further conveyed by the conveyance roller 13 toward a platen 20 described later, and after print processing is performed, the sheet K is conveyed toward the discharge roller 14. Further, the sheet K is conveyed toward the discharge tray 15 by the discharge roller 14.

The platen 20 is provided below the portion between the conveyance roller 13 and the discharge roller 14 of the above-mentioned conveyance path H. A carriage 21 is provided above the platen 20. An ejection head 22 that ejects ink from nozzles is attached to the carriage 21. The carriage 21 is movably supported by a guide frame 21*a* extending in the left-right direction (main scanning direction Ds).

In this configuration, the sheet K fed from the accommodating portion 11 is conveyed by the paper feed roller 12 toward the conveyance roller 13 via the inner surface of the cover 16. After that, the sheet K is conveyed to the position below the ejection head 22 by the conveyance roller 13. After an image is printed on the sheet K by the ejection head 22, the printed sheet K is discharged to the discharge tray 15 by the discharge roller 14. In this way, the sheet K is conveyed along the conveyance path H formed from the accommodating portion 11 to the discharge tray 15. In addition to the conveyance roller 13, one or a plurality of other conveyance rollers may be provided in the conveyance path H.

The cover 16 is provided on the back side (rear side) of the housing 2. The cover 16 is substantially formed in a plate shape. The cover 16 has a pair of rotation shafts 16*a* arranged at the base end of a cover main body 25 described later. The cover 16 is movable between a relay position P2 and an open position P3. The relay position P2 is directly below a closed position P1 (that is, the position where the cover 16 is closed) where the cover 16 defines the conveyance path H. The open position P3 is a position where the cover 16 is located farther rearward than the cover 16 at the relay position P2 and opens (exposes) the conveyance path H (that is, the position where the cover 16 is in the fully-open state). A method of moving the cover 16 from the closed position P1 to the open position P3 and a method of moving the cover 16 from the open position P3 to the closed position P1 will be described later.

Figure 3:
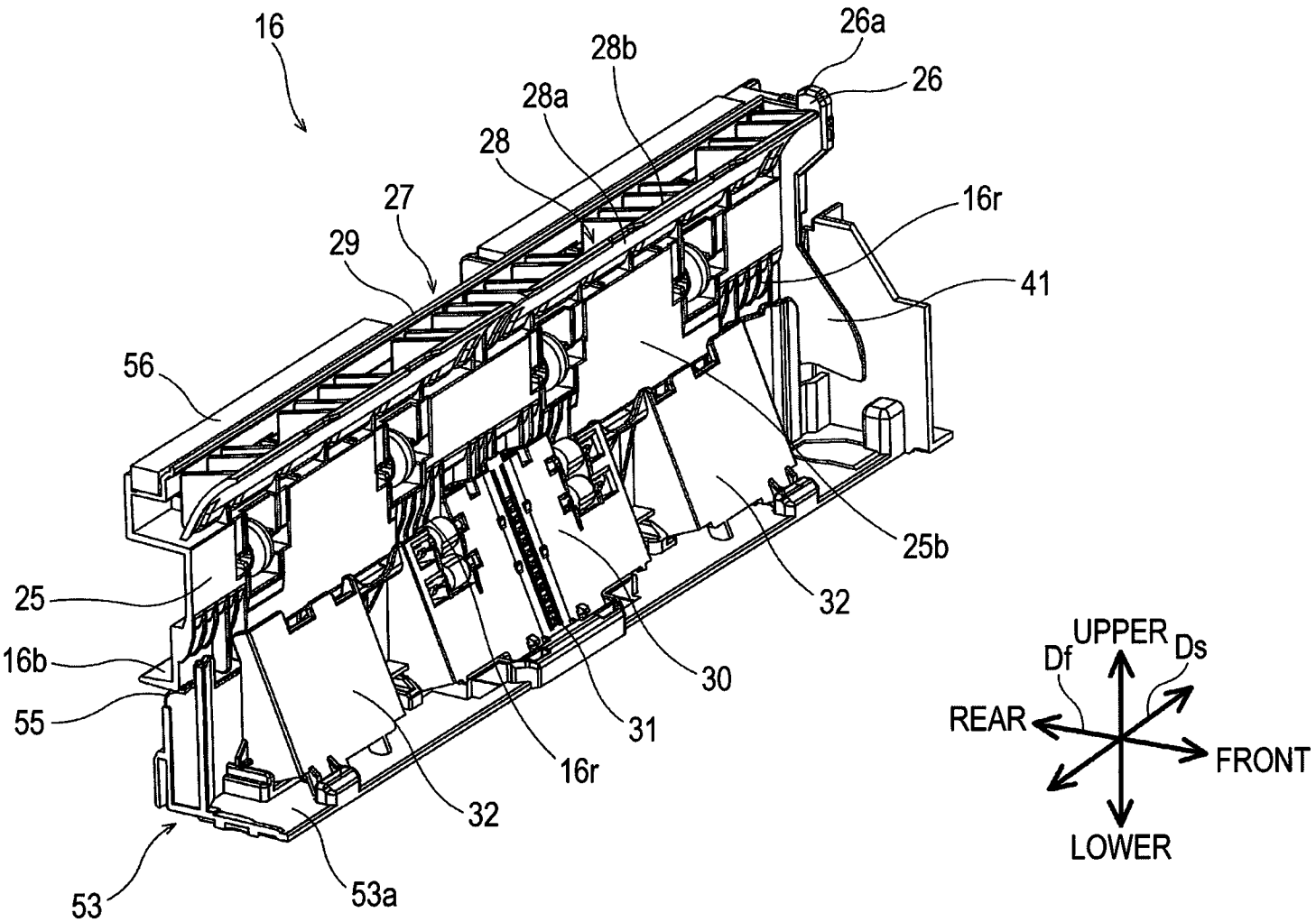
FIG. 3 is a perspective view of a case where a cover and a support member are viewed from the front.

As shown in FIG. 3, the cover 16 extends in a main scanning direction Ds. Reference sign Df is a sub-scanning direction which is a direction perpendicular to the main scanning direction Ds. As shown in FIG. 3, the cover 16 includes a cover main body 25 extending in the main scanning direction Ds, a pair of cover engaging portions 26, a pair of ribs 42 (FIG. 7), an operating portion 27, a guide flap 28, and a protection rib 29 extending in the main scanning direction Ds.

When moving the cover 16 from the open position P3 to the closed position P1 via the relay position P2, the user grasps the operating portion 27. The operating portion 27 is configured as a cutout (groove) portion formed by forming a cutout in a thickness portion of the cover main body 25. The width (the length in the main scanning direction Ds) of the operating portion 27 is set to a length sufficient to accommodate one finger (for example, an index finger) of the user. The operating portion 27 is disposed at the center in the main scanning direction Ds of the cover main body 25. Due to this, since the pressing force generated by the operation of the user on the operating portion 27 is evenly transmitted toward both ends from the center in the main scanning direction Ds of the cover main body 25, the cover 16 can be lowered without tilting the cover main body 25 too much when pushing the cover main body 25 down.

Each of the pair of cover engaging portions 26 is provided at both ends in the main scanning direction Ds of the cover main body 25. Each cover engaging portion 26 is provided at a higher position than the rotation shaft 16*a* and is formed in a convex shape so as to protrude farther upward than the upper end of the cover main body 25. Each cover engaging portion 26 has an inclined surface 26*a* (chamfer surface) that is disposed at a rear end thereof (an end in a direction in which the cover 16 opens) and engages a cover stopper 50 described later when the cover 16 moves from the relay position P2 toward the closed position P1. A side plate portion 41 is formed at the lower side of and connected integrally to each cover engaging portion 26. Each rotation shaft 16*a* is provided in each side plate portion 41 and is disposed so as to protrude in a direction away from the center of the cover main body 25 in the main scanning direction Ds. A portion of each side plate portion 41 is formed in a circular arc shape, for example. In FIG. 3, since one end (the end on the near side in the drawing surface) in the main scanning direction Ds of the cover 16 is cut out, the cover engaging portion 26 and the side plate portion 41 at that end are not shown.

Figure 6:
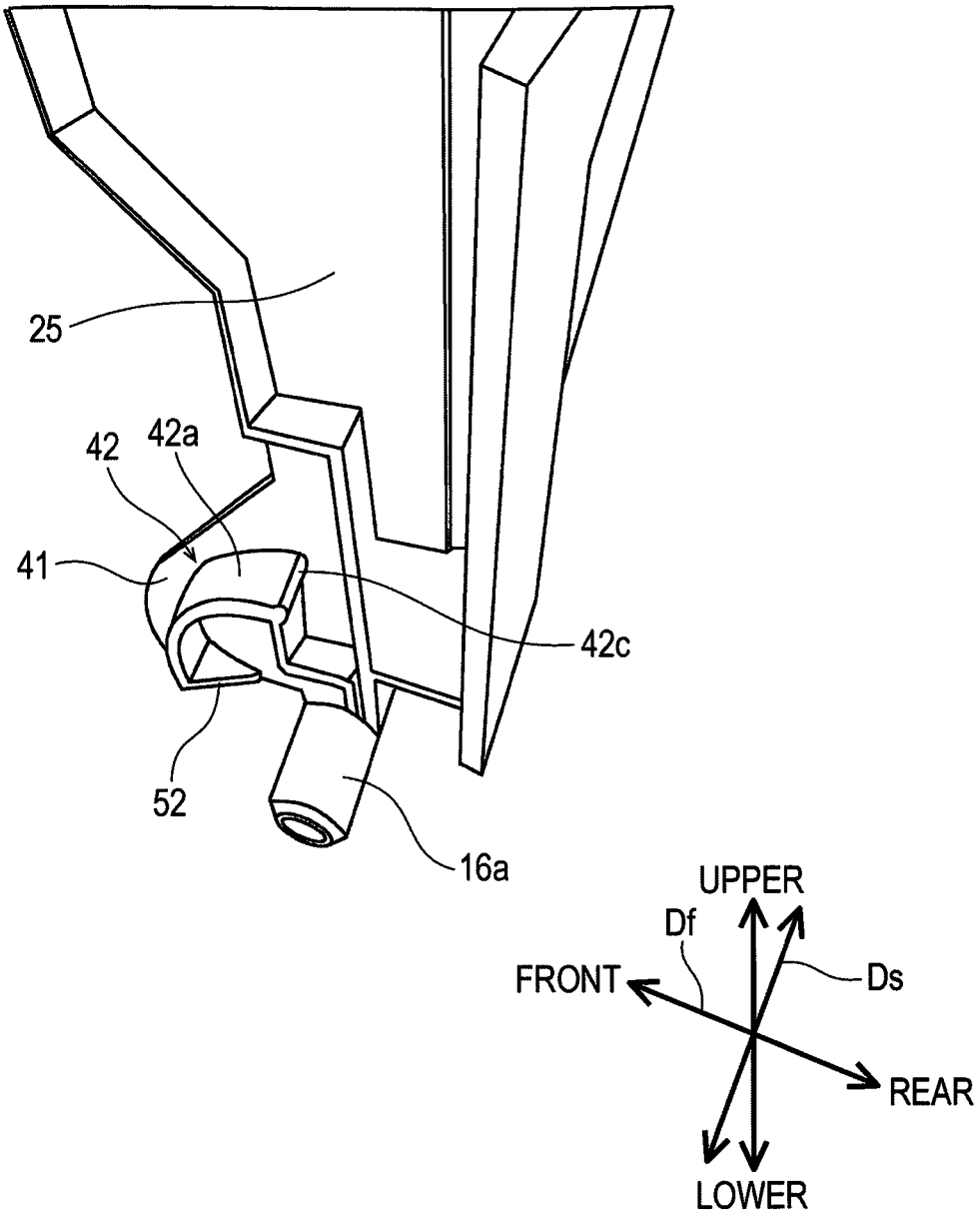
FIG. 6 is a partial perspective view showing a rib and other members provided at the cover.
Figure 7:
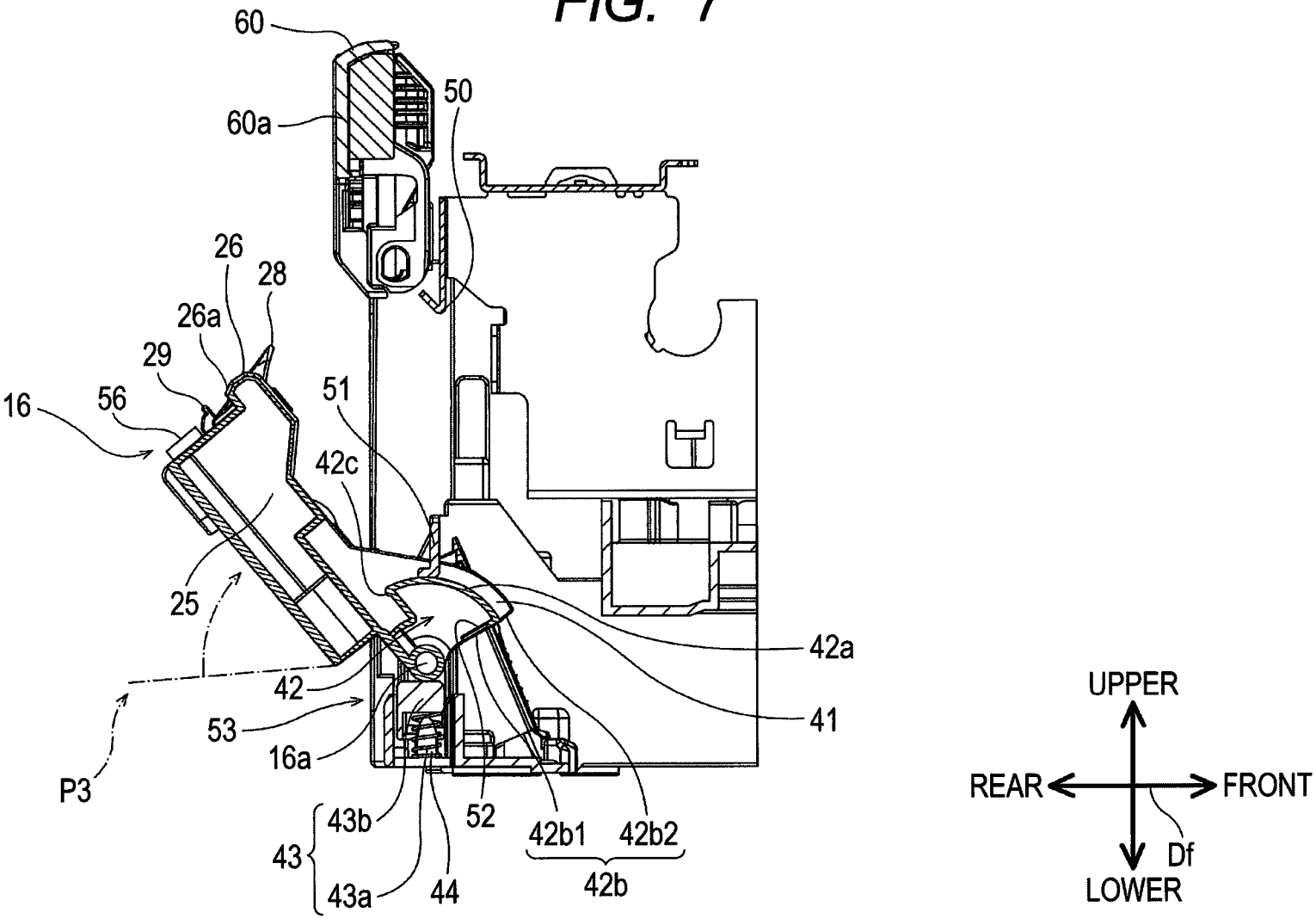
FIG. 7 is a cross-sectional view of the image recording apparatus for showing the state of the cover that moves from an open position to a relay position.

The pair of ribs 42 is provided at both ends in the main scanning direction Ds of the cover main body 25. Each rib 42 is formed integrally with the side plate portion 41 so as to protrude from the side plate portion 41 outwardly in the main scanning direction Ds. More specifically, as shown in FIGS. 6 and 7, each rib 42 includes a rib engagement surface 42*a* formed in a circular arc shape having a constant radius about the corresponding rotation shaft 16*a*, an interference avoiding portion 42*b*, and a protruding portion 42*c*. The rib engagement surface 42*a* is provided closer to a base end of the cover main body 25 than the cover engaging portion 26 and is formed in an arc shape about the rotation shaft 16*a*. In the present embodiment, the rib engagement surface 42*a* is formed in a circular arc shape.

As shown in FIGS. 7 to 10, the conveyance device 1 of the present embodiment is provided with an urging member 43 for urging the rotation shafts 16*a* of the cover 16 in an upward direction. The urging member 43 is provided for each rotation shaft 16*a* and is disposed on the lower side of the corresponding rotation shaft 16*a*. The cover 16 is urged upward by the urging member 43 with the rotation shaft 16*a* disposed therebetween. Each urging member 43 includes a spring 43*a* and a lifter 43*b* that receives the urging force of the spring 43*a* to press the rotation shaft 16*a*.

The cover stopper 50 that engages the cover engaging portion 26 to restrict rotational movement of the cover 16 toward the open position P3 when the cover 16 is located at the closed position P1 is provided in the housing 2. The cover stopper 50 is formed in an approximately V-shape in a side view and has a lower end located at a height lower than the upper end of the cover engaging portion 26 when the cover 16 is located at the closed position P1. The lower end of the cover stopper 50 is formed in a rounded shape, for example. A manual feed tray 60 (upper tray) is provided such that the manual feed tray 60 is located at the upper side of the cover 16 when the cover 16 is located at the closed position P1. The manual feed tray 60 is configured to be rotatable between a closed position and a paper feed position (see FIG. 13) which is an open position about a rotation shaft (not shown) extending in the main scanning direction Ds relative to the main body of the image recording apparatus 10.

A pair of rotation guides 51 that contacts the rib engagement surface 42*a* of the rib 42 from above during rotation of the cover 16 to guide rotation of the cover 16 between the open position P3 and the relay position P2 is provided in the housing 2. Each rotation guide 51 is formed in an L-shape, for example, in a side view, and has a wall portion extending in the upper-lower direction and a lowermost portion extending rearward from a lower end thereof. In other words, the rotation guide 51 is formed in an inverted-L-shape when viewed in the direction as shown in FIG. 7. When the cover 16 is located at the closed position P1, the lowermost portion of each rotation guide 51 is located at a height lower than the protruding portion 42*c* of each rib 42. A front portion of the lowermost portion of the rotation guide 51 is formed in a circular arc shape, for example. At least part of the rotation guide 51 overlaps the urging member 43 in a plan view.

The protruding portion 42*c* is provided at a rear end of the circular arc-shaped rib engagement surface 42*a* and protrudes toward the wall portion of the rotation guide 51 when the cover 16 is located at the closed position P1. The protruding portion 42*c* is formed in a circular arc shape, for example. With this configuration, the protruding portion 42*c* makes point-contact rather than surface-contact with the wall portion of the rotation guide 51 when the cover 16 moves between the relay position P2 and the closed position P1.

Figure 10:
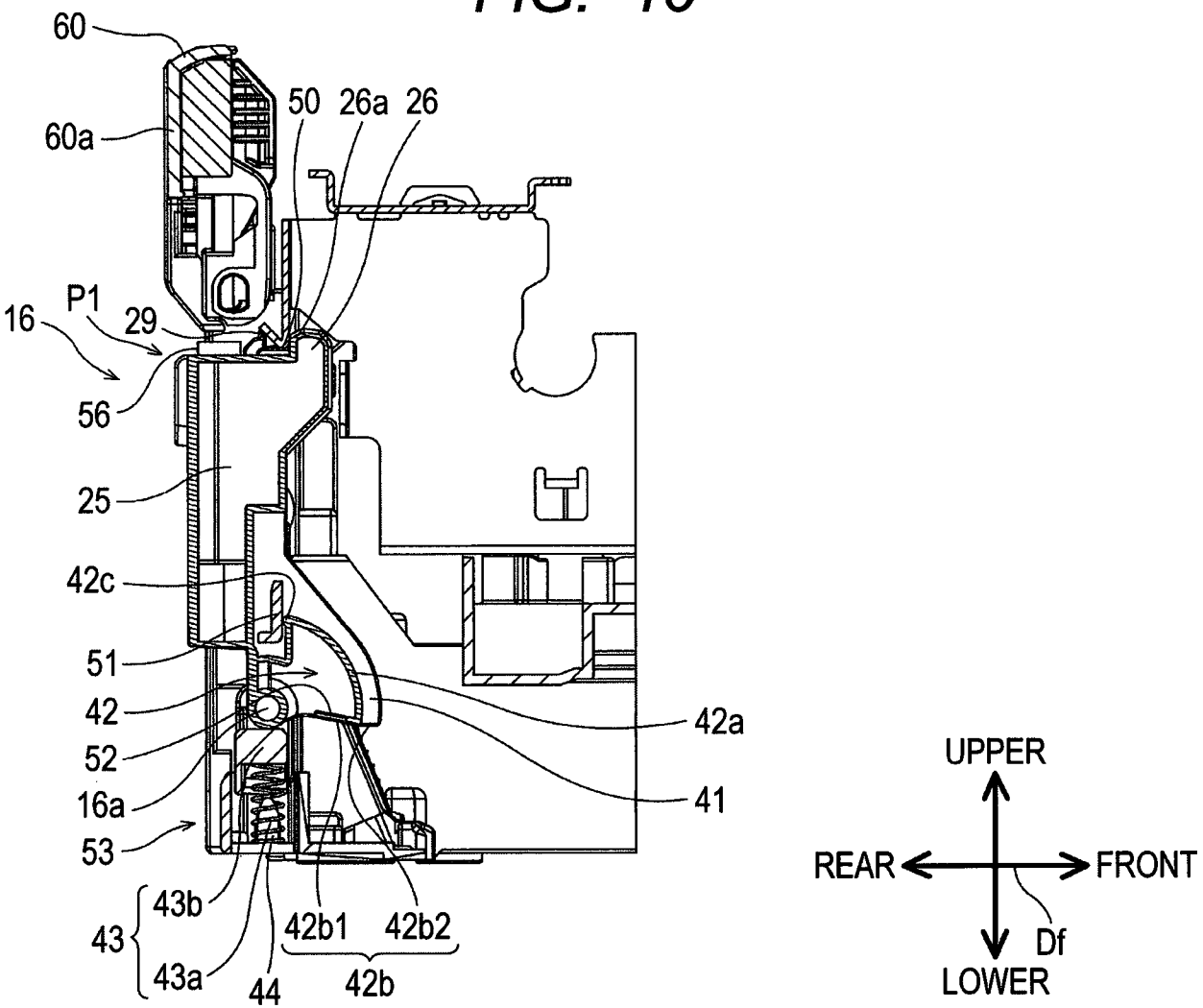
FIG. 10 is a cross-sectional view of the image recording apparatus for showing the state of the cover located at a closed position.

The interference avoiding portion 42*b* has at least two surfaces 42*b*1 and 42*b*2 that are continuous to the rib engagement surface 42*a* and have different gradients in order to avoid interference with the accommodating portion 11 when the cover 16 is located at the closed position P1. As shown in FIG. 10, when the cover 16 is located at the closed position P1, the surface 42*b*2 extends along the front-rear direction and the surface 42*b*1 is inclined downward as it approaches the front. More specifically, the accommodating portion 11 is inserted straight from the front to the rear into the image recording apparatus 10. If the surface 42*b*2 is inclined downward at the same angle as the surface 42*b*1, the accommodating portion 11 interferes with (hits) the surface 42*b*2. Hence, the angle of the surface 42*b*2 is changed such that the angle of the surface 42*b*2 relative to the horizontal direction is smaller than that of the surface 42*b*1, in other words, such that the angle of the surface 42*b*2 is close to an angle parallel to the insertion direction of the accommodating portion 11 (the horizontal direction).

Figure 4:
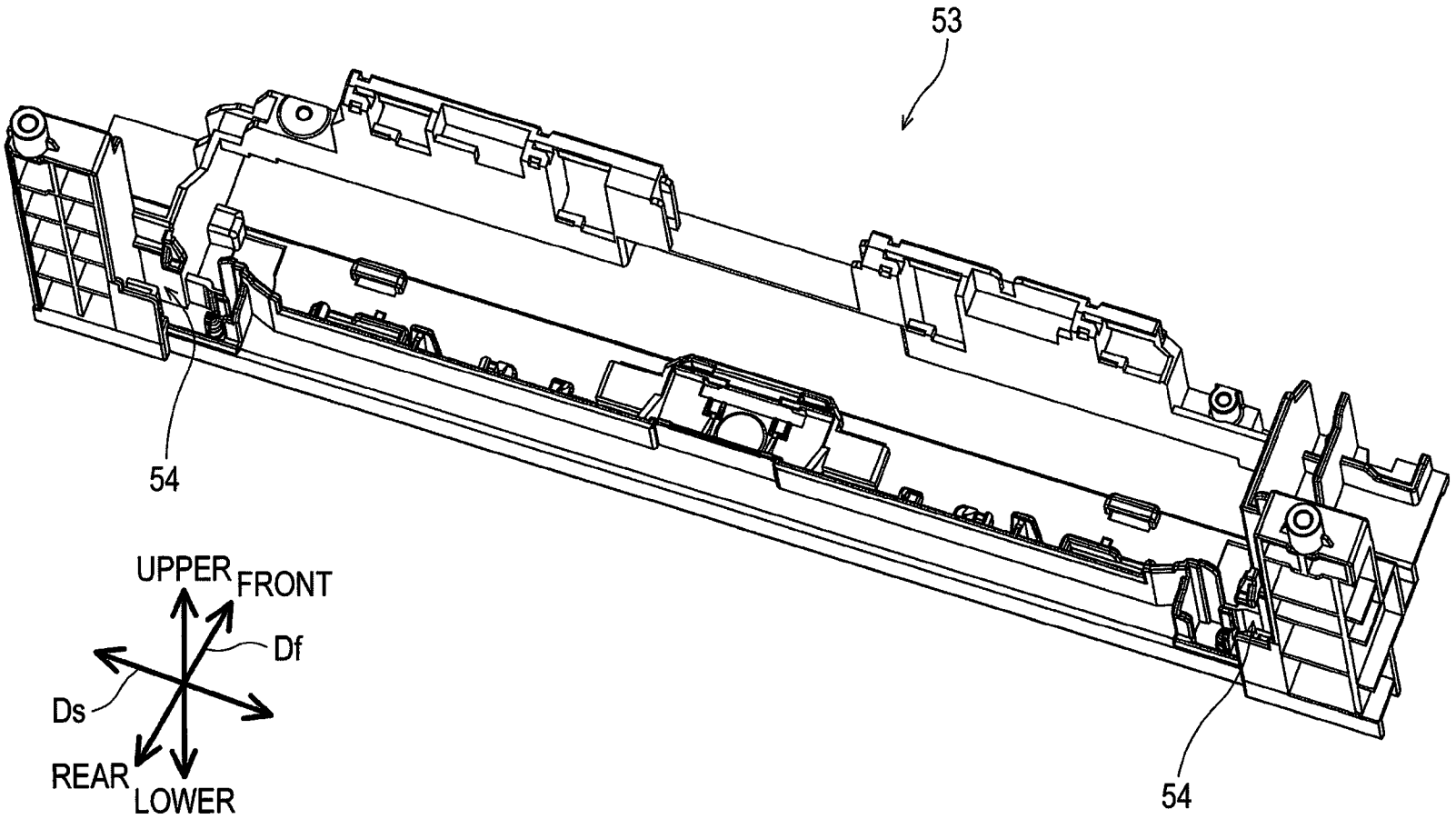
FIG. 4 is a perspective view of a case where the support member in FIG. 3 is viewed from diagonally above.

A support member 53 shown in FIG. 4 is provided in the conveyance device 1 of the present embodiment. As shown in FIG. 4, the support member 53 is a member with which the cover 16 is assembled so as to be rotatable via the rotation shaft 16*a*. That is, the support member 53 rotatably supports the cover 16. The support member 53 extends in the main scanning direction Ds. In order to realize a guiding function when pressing the cover 16 down, a support guide 54 is provided at both sides in the main scanning direction Ds of the support member 53. The rotation shaft 16*a* of the cover 16 fits in the support guide 54 so as to be rotatable and movable up and down. Each support guide 54 is formed so that the corresponding rotation shaft 16*a* is sandwiched between the wall portions in the front-rear direction. Each support guide 54 extends in the upper-lower direction. Each support guide 54 sandwiches the pair of lifters 43*b* between the wall portions in the front-rear direction and guides the lifter 43*b* so as to be movable in the upper-lower direction. In such a configuration, when the cover 16 is assembled into the support member 53, each rotation shaft 16*a* is inserted into each support guide 54 from above and is pushed down. In this way, each rotation shaft 16*a* is located at a predetermined position of each support guide 54. As shown in FIG. 6, an inclined portion 52 inclined in a direction from the outer side of the cover 16 toward the inner side is provided at the rib 42 of the cover 16 so as to facilitate assembly to the support member 53 and positioning of the rib 42 at the predetermined position. When the cover 16 is assembled to the support member 53, the inclined portion 52 contacts and slides on the support member 53, whereby assembling of the cover 16 to the support member 53 and positioning of the rib 42 at the predetermined position are facilitated.

More specifically, as shown in FIG. 6, the inclined portion 52 is inclined in a direction toward the center of the cover 16 in the main scanning direction Ds as it approaches from the front toward the rear. When the cover 16 is pushed from above and assembled to the support member 53 (the apparatus housing) by pushing the cover 16, the inclined portion 52 contacts and slides on a part of the support member 53 so that the rib 42 is bent inward in the main scanning direction Ds. Because the rib 42 is bent inward, interference of the rib 42 with the support member 53 is prevented, and assembly of the cover 16 is facilitated. That is, when the cover 16 is assembled to the support member 53, the rib 42 is bent inward and the interference of the rib 42 with the support member 53 is prevented. When the cover 16 has been assembled to the appropriate position, the rib 42 returns to its original state. When the rib 42 returns to its original state, the rib 42 and a part of the side plate portion 41 engage the support member 53, and thus the cover 16 is prevented from being unintentionally separated from the support member 53. Thus, in order to separate the cover 16 from the support member 53, the user pushes and bends the rib 42 inward in the main scanning direction Ds so as to release the engagement, and pulls out the cover 16 upward.

Figure 5A:
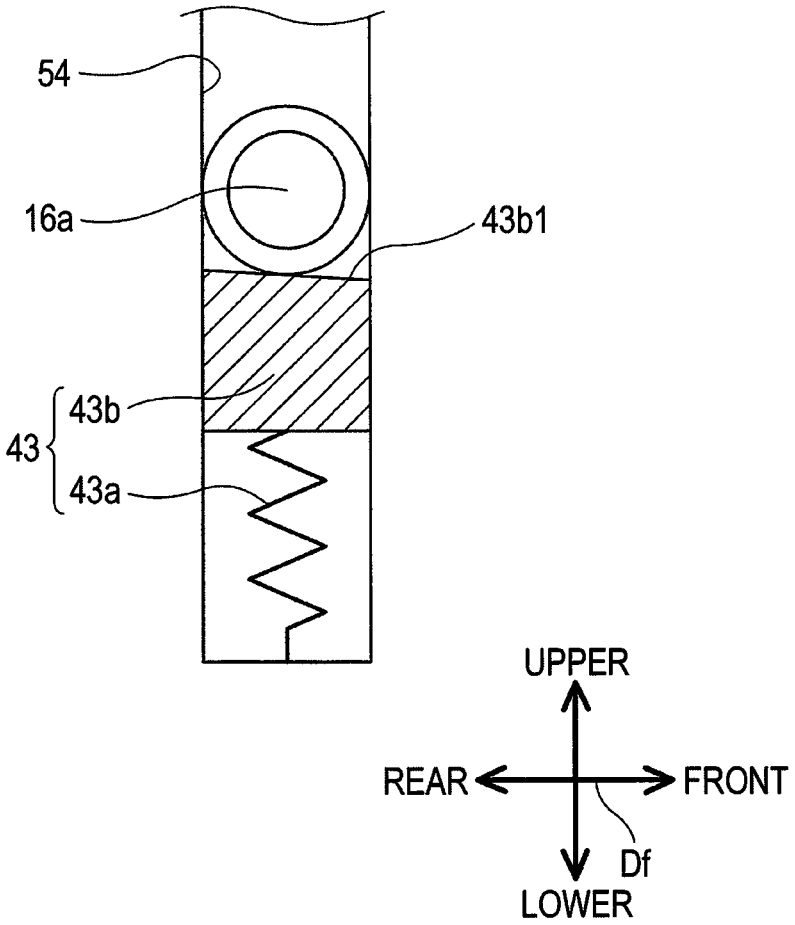
FIG. 5A is an explanatory diagram for explaining a support guide.
Figure 5B:
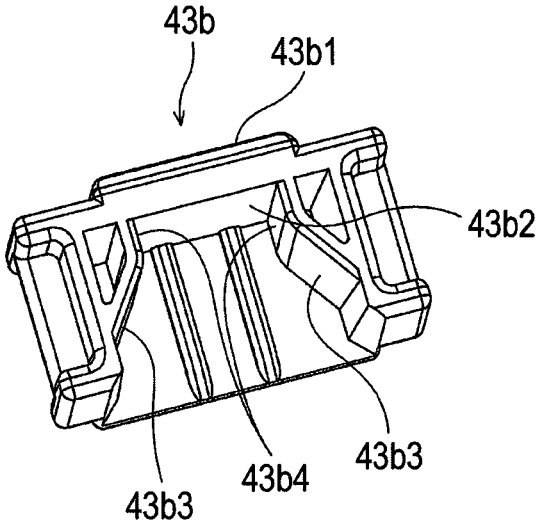
FIG. 5B is a perspective view of a lifter of an urging member.

As shown in FIG. 5A, the urging member 43 as described above is disposed in a lower portion of the support guide 54. When each rotation shaft 16*a* is inserted into the support guide 54 from above and is pushed down, each rotation shaft 16*a* is disposed on the lifter 43*b* of the urging member 43. The spring 43*a* is supported by a protrusion-shaped spring support 44 (FIGS. 7 and 10) provided in a lower portion of the support member 53. The spring support 44 and the support guide 54 are integrally molded as parts of the support member 53. An upper surface 43*b*1 of the lifter 43*b* is inclined so as to press the rotation shaft 16*a* upward and forward (the direction in which the cover 16 moves from the open position to the relay position), that is, so as to be lowered from the rear toward the front. As shown in FIG. 5B, the lifter 43*b* has a contact surface 43*b*2 at the opposite side of the upper surface 43*b*1. The contact surface 43*b*2 contacts the upper end of the spring 43*a* and directly receives the urging force from the spring 43*a*. The lifter 43*b* includes a pair of inclined surfaces 43*b*3 having different inclination angles and a pair of vertical surfaces 43*b*4 that connects each inclined surface 43*b*3 and the contact surface 43*b*2. One inclined surface 43*b*3 and the other inclined surface 43*b*3 are disposed so as to face each other, and one vertical surface 43*b*4 and the other vertical surface 43*b*4 are disposed so as to face each other. The inclined surfaces 43*b*3 and the vertical surfaces 43*b*4 guide assembling of the spring 43*a* and position the spring 43*a* such that the urging direction of the spring 43*a* is perpendicular to the contact surface 43*b*2 when the spring 43*a* and the lifter 43*b* are assembled to the support member 53. In this way, the direction of urging force of the spring 43*a* urging the lifter 43*b* is reliably set in the upper-lower direction. The inclined surfaces 43*b*3 and the vertical surfaces 43*b*4 are examples of a spring positioning portion.

Next, a method of moving the cover 16 at the open position P3 to the closed position P1 via the relay position P2, that is, a method of closing the cover 16 in an open state will be described with reference to the drawings.

In a state where the cover 16 is located at the open position P3, the rotation guide 51 contacts the rib engagement surface 42*a* of the rib 42 from above. Due to this, the cover 16 is allowed to only rotate and vertical movement is restricted by the lowermost portion of the rotation guide 51 except when the cover 16 is pushed down against the urging force of the urging member 43. As shown in FIG. 7, a user presses the cover 16 at the open position P3 toward the front while grasping the operating portion 27 as described above or placing a finger on the operating portion 27. By doing so, the cover 16 is rotated toward the front (clockwise in FIG. 7) about the rotation shaft 16*a* in a state where the rotation guide 51 is in contact with the rib engagement surface 42*a* of the rib 42 from above.

Figure 8:
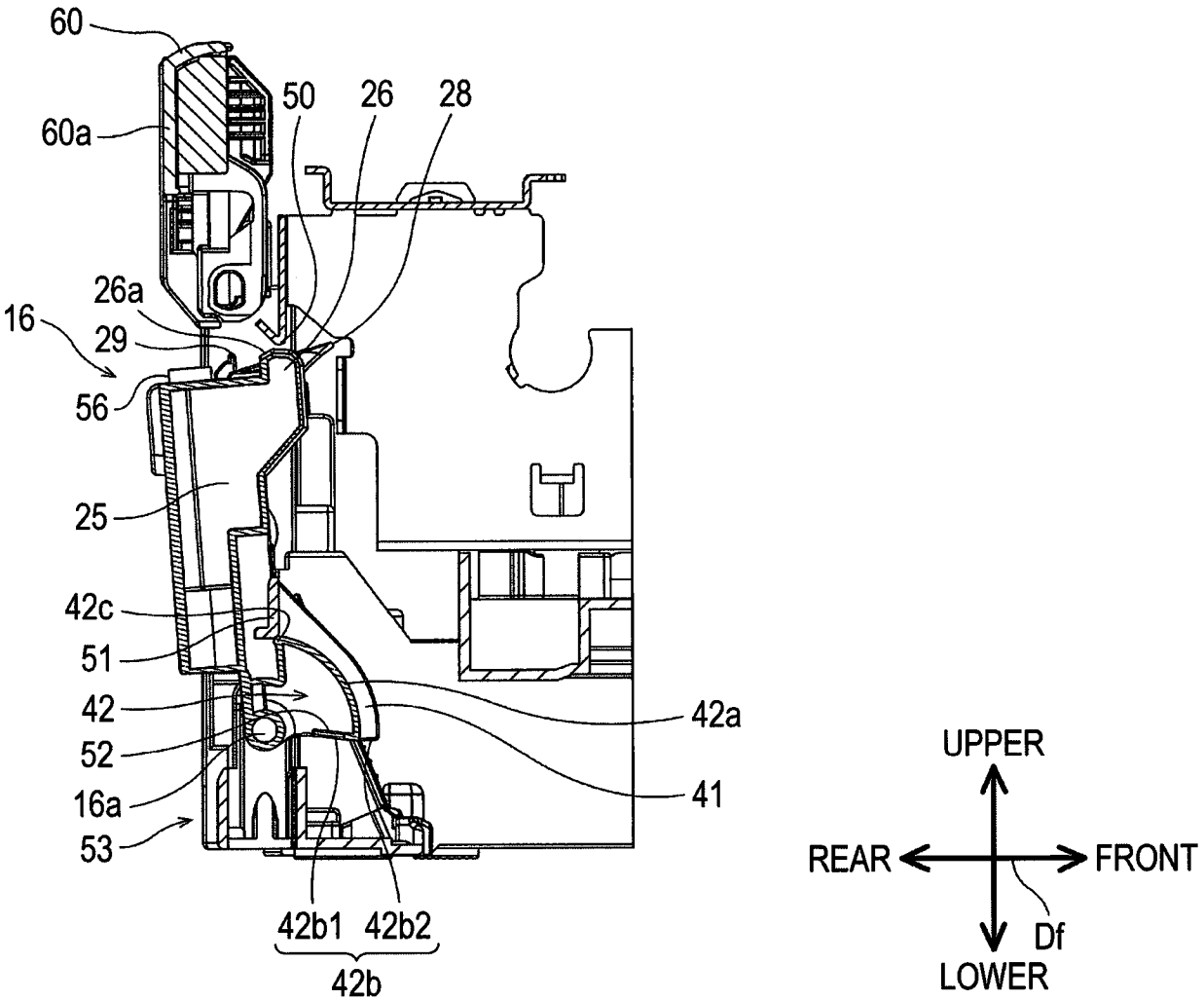
FIG. 8 is a cross-sectional view of the image recording apparatus for showing the state of the cover immediately before the cover reaches the relay position.
Figure 9:
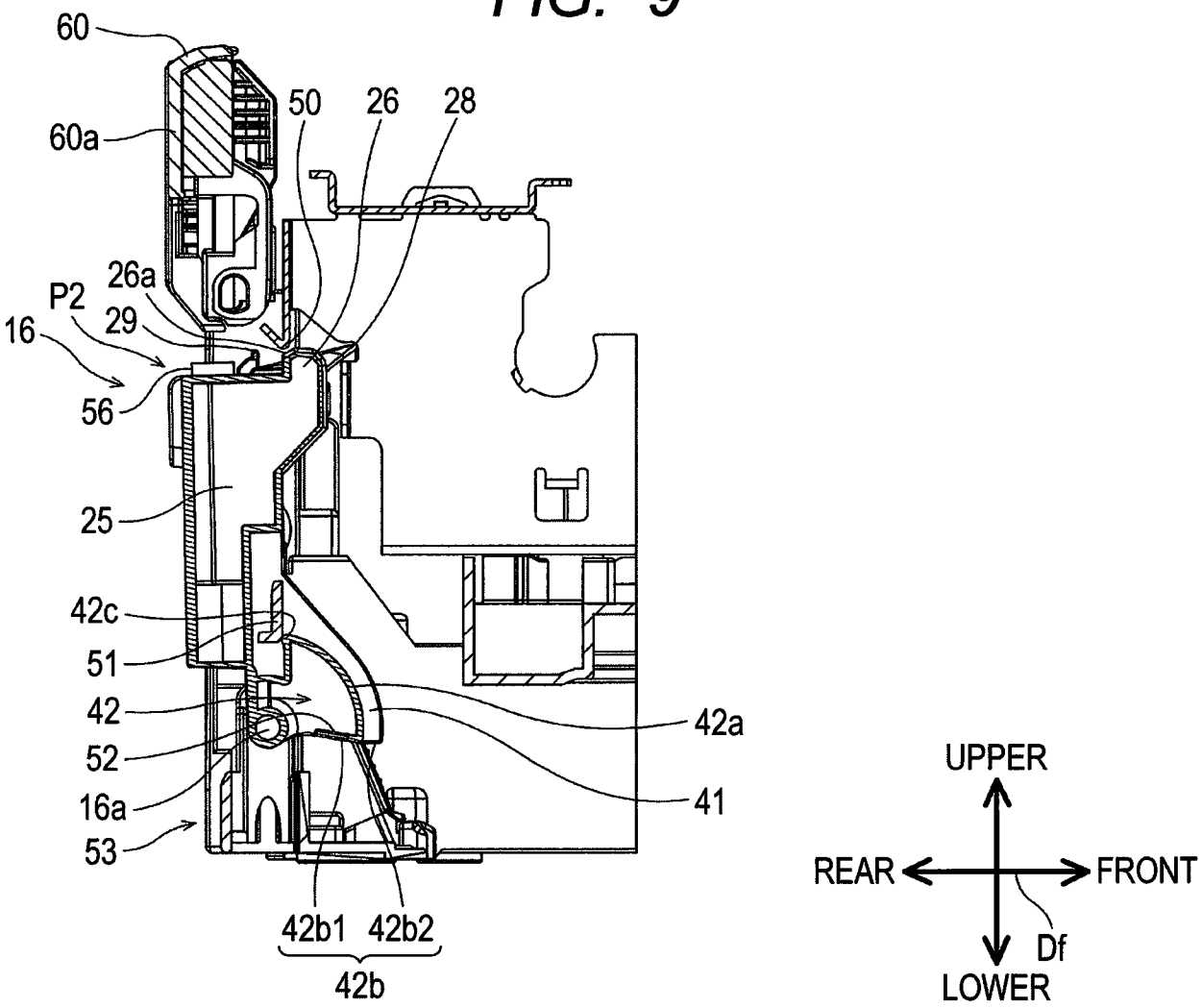
FIG. 9 is a cross-sectional view of the image recording apparatus for showing the state of the cover located at the relay position.

Subsequently, as shown in FIG. 8, immediately before the cover 16 rotating from the open position P3 reaches the relay position P2, a circular arc portion at the front side of the lowermost portion of the rotation guide 51 engages the protruding portion 42*c* of the rib 42. In this way, in a state where the forward pressing force of the user is applied to the cover 16, the circular arc portion of the rotation guide 51 and the protruding portion 42*c* are easily disengaged, and therefore, the cover 16 easily reaches the relay position P2 as shown in FIG. 9 without the user forcibly pressing further. That is, the combination of the circular arc portion of the rotation guide 51 and the protruding portion 42*c* induces and facilitates movement of the cover 16 toward the relay position P2.

When the cover 16 reaches the relay position P2, the restriction of the rotation guide 51 with respect to the upward movement of the rib engagement surface 42*a* and the protruding portion 42*c* of the rib 42 is released. Thus, as shown in FIG. 10, the cover 16 moves upward from the relay position P2 to the closed position P1 while the protruding portion 42*c* slides on the wall portion of the rotation guide 51. In this case, since the protruding portion 42*c* slides on the rotation guide 51 in a state of point-contact with the wall portion of the rotation guide 51, the friction between the protruding portion 42*c* and the rotation guide 51 is reduced, and the cover main body 25 is easily pushed upward. When the cover 16 moves upward, the cover engaging portion 26 engages the cover stopper 50. When the cover engaging portion 26 engages the cover stopper 50 in this manner, the rotational movement of the cover 16 located at the closed position P1 is restricted. By the above-described method, the cover 16 at the open position P3 is moved to the closed position P1 via the relay position P2.

In contrast, a method of moving the cover 16 at the closed position P1 to the open position P3 via the relay position P2 is as follows, which is basically the reverse order of the method of closing the cover 16 as described above.

The user pushes the cover 16 down against the upward urging force of the urging member 43 in a state of placing a finger on the operating portion 27 or grasping the operating portion 27. In this way, it is possible to move downward the cover 16 from the closed position P1 to the relay position P2. Moreover, in the course of the cover 16 moving from the closed position P1 to the relay position P2, the engagement of the cover engaging portion 26 with respect to the cover stopper 50 is released. In this case, the protruding portion 42*c* of the rib 42 engages the rotation guide 51 in a state where the upward movement is still not restricted by the rotation guide 51. That is, the protruding portion 42*c* slides on the rotation guide 51 in a state of point-contact with the rotation guide 51. In this way, the friction between the protruding portion 42*c* and the rotation guide 51 is reduced and the cover main body 25 is easily pushed down.

When the cover 16 is moved downward so that the cover 16 reaches the relay position P2, the circular arc portion on the front side of the lowermost portion of the rotation guide 51 engages the protruding portion 42*c* of the rib 42. In this way, the engagement between the circular arc portion of the rotation guide 51 and the protruding portion 42*c* is easily released, and as a result, the rib engagement surface 42*a* contacts the lowermost portion of the rotation guide 51 and is easily guided rearward. As described above, in the present embodiment, after the engagement of the cover engaging portion 26 with the cover stopper 50 is released, the engagement between the rib engagement surface 42*a* and the rotation guide 51 starts.

Subsequently, the user rotates the cover 16 toward the rear by using the operating portion 27. In this case, the protruding portion 42*c* of the rib 42 is guided toward the rear side by the rotation guide 51 in a state where the upward movement thereof is restricted by the rotation guide 51. In this way, the cover 16 reaches the open position P3. By the above-described method, the cover 16 at the closed position P1 is moved to the open position P3 via the relay position P2.

As shown in FIG. 3, path forming members 30 and 32 define the conveyance path H together with the cover 16, and are at least partially arranged at the lower side of the cover 16. The path forming members 30 and 32 may be formed integrally rather than as separate members. The path forming member 30 is disposed between two path forming members 32 arranged in the main scanning direction Ds. The path forming members 30 and 32 are arranged on a lower portion 53*a* of the support member 53 extending toward the front. The path forming members 30 and 32 are inclined downward to the right as they advance from the rear toward the front in order to form the conveyance path H.

A plurality of sheet passage ribs 16*r* and an abutted portion 16*b* are provided on the cover 16. A space is present between one sheet passage rib 16*r* and other sheet passage rib 16*r* of adjacent sheet passage ribs 16*r*. The plurality of sheet passage ribs 16*r* is arranged at the front side (the side facing the conveyance path H) of the cover 16 and arranged side by side in the main scanning direction Ds, and a conveyed sheet K contacts the sheet passage ribs 16*r*. Due to the presence of such sheet passage ribs 16*r*, the conveyance resistance of the sheet K is reduced. The abutted portion 16*b* is formed in an approximately L-shape.

A restricting portion 55 is provided in a rear portion of the support member 53 so that the sheet passage ribs 16*r* do not interfere with the support member 53 and the path forming members 30 and 32 during downward movement of the cover 16.

The restricting portion 55 is provided at the outer side of the housing 2. That is, the restricting portion 55 is provided at a position outside the conveyance path H. The restricting portion 55 contacts the abutted portion 16*b* to restrict downward movement of the cover 16 of a particular amount or more when the cover 16 moves downward from the closed position P1 to the relay position P2. The restricting portion 55 is formed in a circular arc shape, for example. Due to this, when the cover 16 moves from the relay position P2 to the open position P3, the abutted portion 16*b* of the cover 16 rotationally moves along the outer shape of the circular arc-shaped restricting portion 55. In this way, the downward movement of the cover 16 is restricted until the sheet passage rib 16*r* is separated toward the rear relative to the support member 53 and the path forming members 30 and 32. Due to this restricting portion 55, the contact of the sheet passage ribs 16*r* with the support member 53 and the path forming members 30 and 32 is avoided when the cover 16 moves downward from the closed position P1 to the relay position P2.

The path forming member 30 has a plurality of protrusions 31 protruding from its inclined surface and arranged in the conveyance direction. In such a configuration, when a plurality of sheets K are conveyed to the path forming member 30 in an overlapping state, a lower sheet K is caught by the protrusions 31 and is separated from an upper sheet K. In this way, the plurality of sheets K is prevented from being conveyed to the downstream side of the path forming member 30 in an overlapping state.

Figure 11:
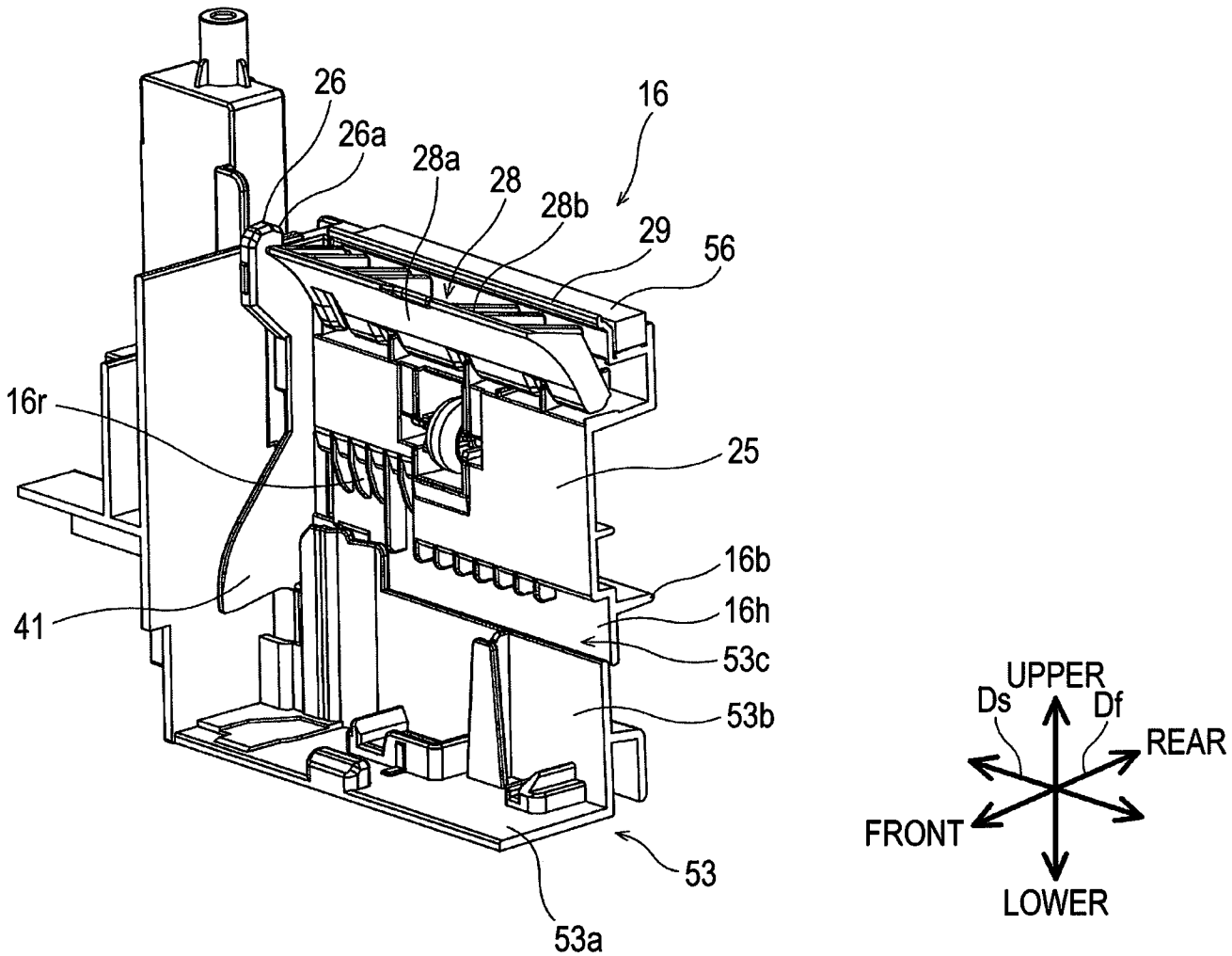
FIG. 11 is a partial perspective view showing the positional relationship between a cutout portion of the support member and a covering portion of the cover.
Figure 12:
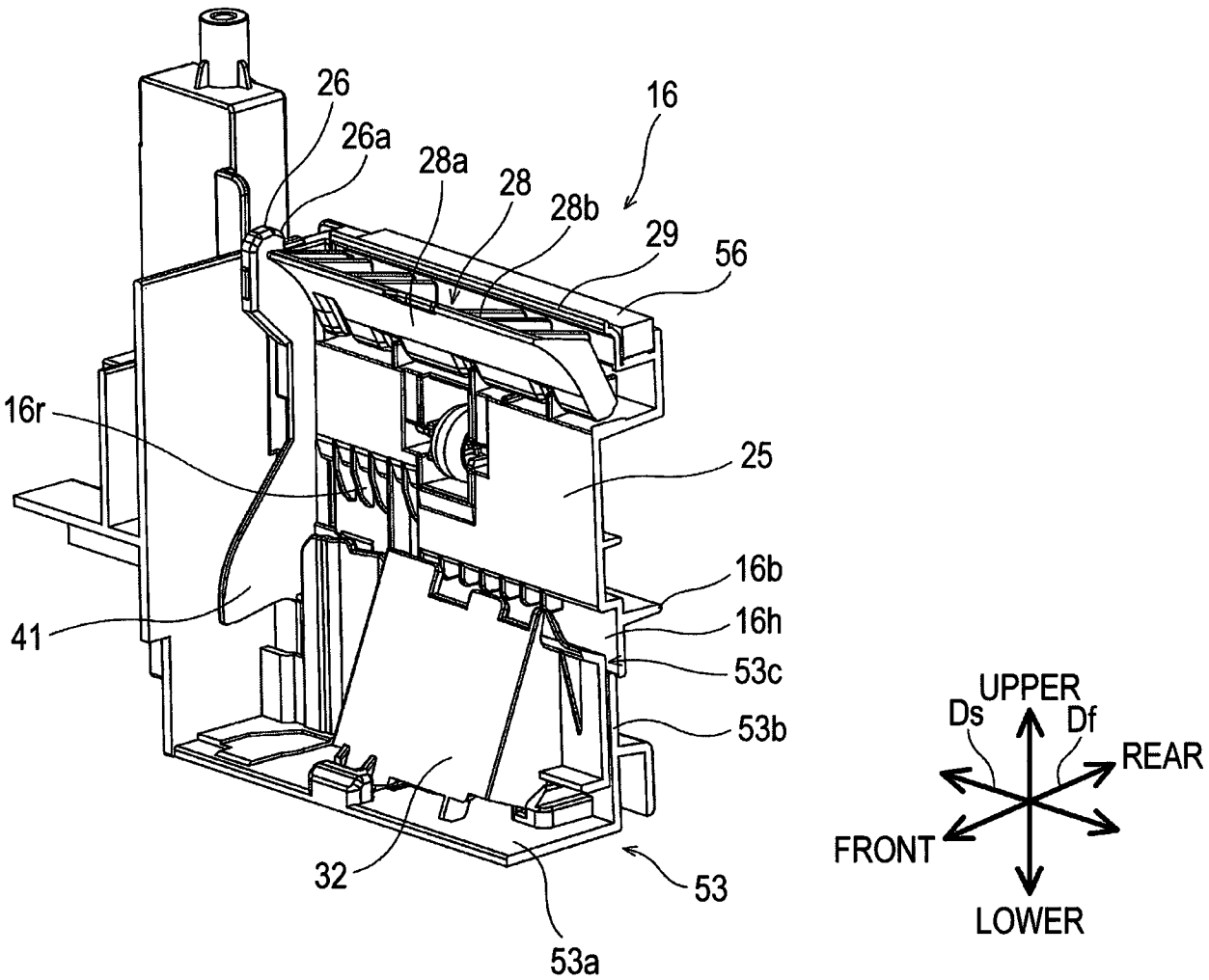
FIG. 12 is a partial perspective view showing the state where a path forming member is arranged in the state of FIG. 11.

As described above, since the cover 16 moves downward, it is necessary to prevent interference with the support member 53. Thus, as shown in FIGS. 11 and 12, a cutout portion 53*c* is formed in an upper part of a rear wall 53*b* of the support member 53 extending vertically. The cutout portion 53*c* is located at (separated from) the front of the cover main body 25 of the cover 16. The cover 16 has a covering portion 16*h* that covers the cutout portion 53*c* from the rear when the cover 16 is located at the closed position P1. This prevents entering of dusts and so on from the cutout portion 53*c* and leakage of operating noise when the cover 16 is located at the closed position P1. FIGS. 11 and 12 are perspective views illustrating a state where the cover 16 and the support member 53 are cut at a particular position in the main scanning direction Ds, and FIG. 11 illustrates a state where the path forming member 32 is not shown.

Figure 13:
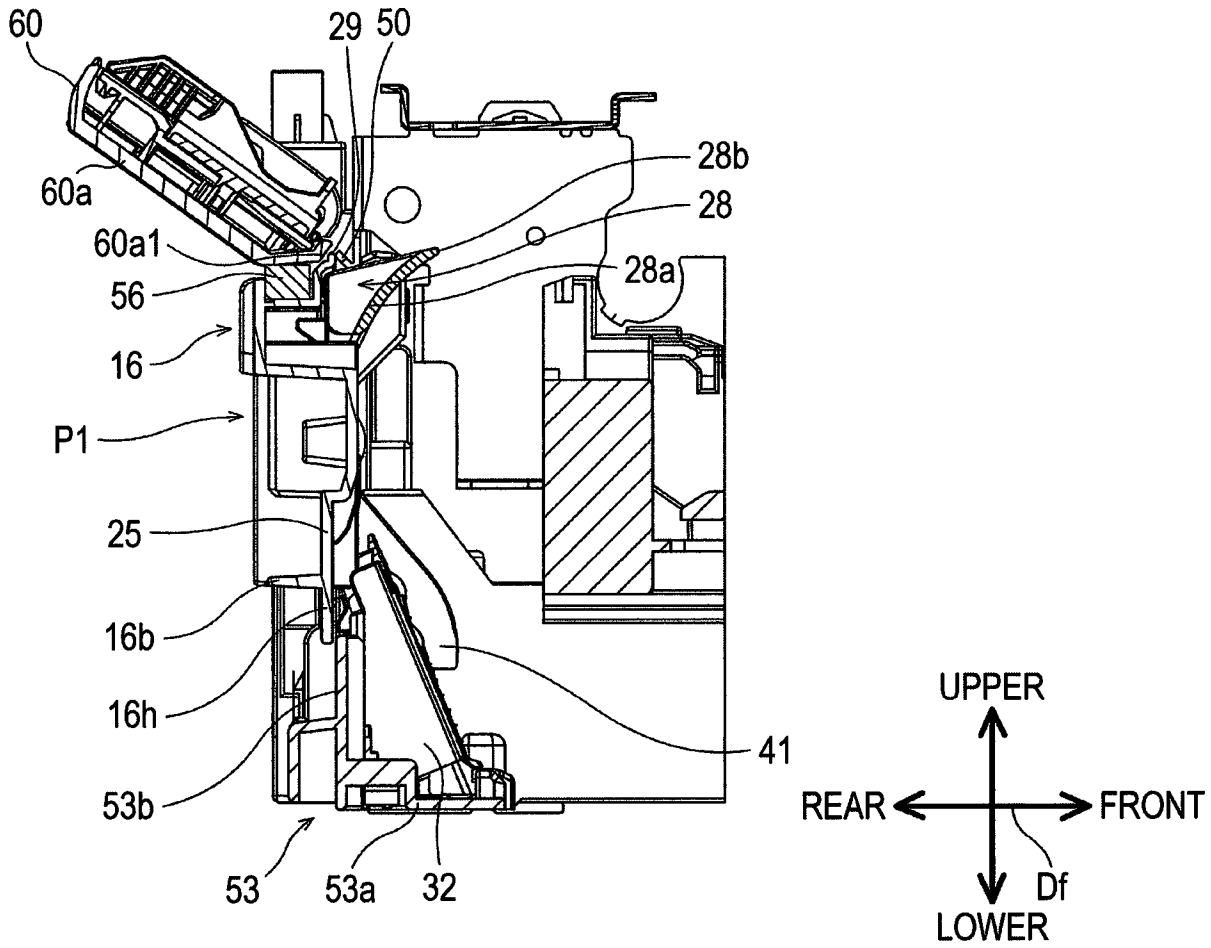
FIG. 13 is a cross-sectional view of the image recording apparatus showing the positional relationship between an upper end of a protection rib and peripheral members.

As shown in FIGS. 3 and 13, the guide flap 28 is provided in an upper part of the cover 16 to define a part of the conveyance path H, similarly to the cover 16. The guide flap 28 has a curved surface portion 28*a* in which the side facing the conveyance roller 13 is formed in a curved surface shape. Reference sign 28*b* denotes an upper end of the guide flap 28. After the sheet K is guided to the cover main body 25, the sheet K is conveyed toward the conveyance roller 13 by sliding on the curved surface portion 28*a*. The cover 16 has the protection rib 29 having an upper end located at a higher position than at least part of the guide flap 28 when the cover 16 is located at the closed position P1.

A cover portion 60*a* is provided at the manual feed tray 60. The cover portion 60*a* covers the rear of the manual feed tray 60 in a state where the manual feed tray 60 is located at a closed position (for example, the state of FIG. 10). As shown in FIG. 13, when the manual feed tray 60 is rotated and the cover 16 is located at the closed position P1, the upper end of the protection rib 29 is disposed in a gap between the cover stopper 50 and a front end 60*a*1 of the cover portion 60*a* (a front end of the cover portion 60*a* in a state where the manual feed tray 60 is inclined as shown in FIG. 13). This prevents entering of a foreign matter such as dusts and so on from the gap between the cover stopper 50 and the front end 60*a*1 of the cover portion 60*a* and leakage of operating noise. The upper end of the protection rib 29 is located at a higher position than the lower end of the manual feed tray 60 in a state where the manual feed tray 60 is located at the paper feed position. Due to this, the gap between the protection rib 29 and the manual feed tray 60 is reduced. This suppresses entering of a foreign matter and leakage of operating noise. Although the upper end of the protection rib 29 is located at a lower position than the lower end of the manual feed tray 60 in a state where the manual feed tray 60 is located at the closed position (the state of FIG. 10), there is no limitation thereto. The upper end of the protection rib 29 may be located at a higher position than the lower end of the manual feed tray 60 in this state.

A cushioning member 56 such as a sponge, for example, is provided at the upper end of the cover 16. When the cover 16 moves upward from the relay position P2 to the closed position P1, the cushioning member 56 is pressed against the manual feed tray 60 according to the upward movement of the cover 16. In this way, the gap between the manual feed tray 60 and the upper end of the cover 16 is blocked by the cushioning member 56 in a contracted state due to the pressing. This further improves the reliability of preventing the entering of dusts and so on and the reliability of suppressing the leakage of operating noise.

As described above, according to the conveyance device 1 of the present embodiment, even in a state where the cover 16 is urged by the urging member 43, rotation of the cover 16 from the open position P3 to the relay position P2 is smoothly guided by the engagement of the rib engagement surface 42*a* with the rotation guide 51. After the cover 16 is rotated to the relay position P2, restriction by the engagement is released and the cover 16 is moved to the closed position P1 by the urging member 43. This improves the operability of the user when putting the cover 16 from the open state to the closed state and suppresses a half-closed state of the cover 16.

In the present embodiment, since the rib engagement surface 42*a* is formed in a circular arc shape having a constant radius about the rotation shaft 16*a*, sliding of the rib engagement surface 42*a* slides smoothly relative to the rotation guide 51. Due to this, the cover 16 is rotated smoothly.

In the present embodiment, the rib 42 has the protruding portion 42*c* protruding toward the rotation guide 51 when the cover 16 is located at the closed position P1. With this configuration, in a state where the forward pressing force of the user is applied to the cover 16, the circular arc portion of the rotation guide 51 and the protruding portion 42*c* are easily disengaged, and therefore, the cover 16 easily reaches the relay position P2 without the user forcibly pressing further. Since the protruding portion 42*c* slides on the rotation guide 51 in a state of point-contact with the rotation guide 51, the friction between the protruding portion 42*c* and the rotation guide 51 is reduced, and the cover main body 25 is easily pushed upward.

In the present embodiment, the upper surface 43*b*1 of the lifter 43*b* is inclined in a direction of pressing the rotation shaft 16*a* upward and forward, that is, so as to be lowered from the rear toward the front. Generally, since a gap is present between the rotation shaft 16*a* and the inner wall of the support guide 54, the position in the front-rear direction of the rotation shaft 16*a* varies and it is difficult to stabilize the position. In such a state, when the rotation shaft 16*a* is located close to the rear side of the support guide 54 and the force of pressing the cover 16 toward the front is weak, the engagement between the rotation guide 51 and the rib engagement surface 42*a* may not be released and a half-closed state may occur. In contrast, if the rotation shaft 16*a* is moved close to the front side by the upper surface 43*b*1 of the lifter 43*b*, when the cover 16 is moved from the open position P3 to the relay position P2, the protruding portion 42*c* of the rib 42 easily gets over the rotation guide 51 toward the front and the possibility of the cover 16 to becoming a half-closed state is reduced.

In the present embodiment, the lifter 43*b* has the inclined surface 43*b*3 and the vertical surface 43*b*4. This prevents the spring 43*a* from being assembled in an inappropriate position or posture and facilitates positioning of the spring 43*a*.

In the present embodiment, when the cover 16 moves from the closed position P1 to the relay position P2, the rib 42 starts engaging the rotation guide 51 after the cover engaging portion 26 is disengaged from the cover stopper 50, so that the cover 16 is rotated from the relay position P2 to the open position P3. With this configuration, the cover 16 can be rotationally moved in a state where the engagement of the cover engaging portion 26 with the cover stopper 50 is reliably released.

In the present embodiment, at least part of the rotation guide 51 overlaps the urging member 43 in a plan view. With this configuration, the rotation guide 51 functions as a load receiving member that receives the urging force of the urging member 43 via the rib 42.

In the present embodiment, the rib 42 has the interference avoiding portion 42*b* having at least two surfaces 42*b*1 and 42*b*2 having different gradients. Due to this, it is possible to avoid interference of the cover 16 with the accommodating portion 11 when the cover 16 is located at the closed position P1.

In the present embodiment, the cover 16 has the inclined portion 52 inclined in a direction from the outer side of the cover 16 toward the inner side. With this configuration, assembling of the cover 16 to the support member 53 is facilitated.

In the present embodiment, the urging member 43 is disposed at the lower part of the support guide 54. With this configuration, a function of receiving the urging force of the urging member 43, a function of positioning the urging member 43, and a function of guiding the cover 16 (the rotation shaft 16*a*) are attained by one element which is the support guide 54.

In the present embodiment, the cover 16 has the covering portion 16*h* that covers the cutout portion 53*c* of the support member 53 from the rear when the cover 16 is located at the closed position P1. This prevents entering of dusts and so on from the cutout portion 53*c* and leakage of operating noise when the cover 16 is located at the closed position P1.

In the present embodiment, the spring support 44 and the support guide 54 are integrally molded by the support member 53. This improves the accuracy of the positional relationship between the spring 43*a* and the lifter 43*b*. Therefore, the urging force of the spring 43*a* is transmitted to the lifter 43*b* in a desired direction (vertically upward).

In the present embodiment, the restricting portion 55 contacts the cover 16 to restrict downward movement of the cover 16 of a particular amount or more. This prevents the sheet passage rib 16*r* from contacting the path forming member 32 when the cover 16 moves downward from the closed position P1 to the relay position P2.

In the present embodiment, the restricting portion 55 is formed in a circular arc shape. Thus, when the cover 16 rotationally moves from the relay position P2 to the open position P3, the downward movement of the cover 16 is restricted until the sheet passage rib 16*r* is separated toward the rear relative to the path forming members 30 and 32.

In the present embodiment, since the restricting portion 55 is provided at a position outside the conveyance path H, the restricting portion 55 is prevented from becoming an interfering element in the conveyance path H.

In the present embodiment, the cover 16 has the protection rib 29 having an upper end located at a higher position than at least part of the guide flap 28 in a state where the cover 16 is located at the closed position P1. This prevents entering of a foreign matter such as dusts and so on from the gap between the cover stopper 50 and the front end 60*a*1 of the cover portion 60*a* and leakage of operating noise.

In the present embodiment, the upper end of the protection rib 29 is located at a higher position than the lower end of the manual feed tray 60 in a state where the manual feed tray 60 is located at the paper feed position. Thus, the gap between the protection rib 29 and the manual feed tray 60 is reduced. This further suppresses entering of a foreign matter and leakage of operating noise.

In the present embodiment, since the cushioning member 56 is provided at the upper end of the cover 16, the reliability of preventing the entering of dusts and so on and the reliability of suppressing the leakage of operating noise are further improved.

In the present embodiment, the cover engaging portion 26 has the inclined surface 26*a* that engages the cover stopper 50. Thus, even if the cover 16 is slightly tilted toward the rear when the cover 16 moves upward from the relay position P2 toward the closed position P1, the cover 16 is pulled forward to correct the position due to the engagement (contact) between the inclined surface 26*a* and the cover stopper 50.

<Modification>

While the disclosure has been described in detail with reference to the above aspects thereof, it would be apparent to those skilled in the art that various changes and modifications may be made therein without departing from the scope of the claims. Embodiments obtained by appropriately combining the technical features disclosed in different embodiments are also included in the scope of this disclosure.

In the above embodiment, the rib engagement surface 42*a* has a circular arc shape, but the shape is not limited to this. The rib engagement surface 42*a* may have a general arc shape.

In the above embodiment, the spring 43*a* is adopted as the urging member 43, but the present disclosure is not limited to this. An elastic body such as rubber may be used as the urging member.

In the above embodiment, the surface of the cover engaging portion 26 that engages the cover stopper 50 is an inclined surface (chamfer surface) 26*a*, but the present disclosure is not limited to this. The surface of the cover engaging portion 26 may be a circular arc surface (round surface).

In the above embodiment, the lowermost front portion of the rotation guide 51 is formed in a circular arc shape, and the protruding portion 42*c* is formed in a circular arc shape, but the present disclosure is not limited to this. One may be formed as an inclined surface (chamfer surface) and the other may be formed as a circular arc shape (round surface), without forming both surfaces as inclined surfaces (chamfer surfaces).

In the above embodiment, the cover stopper 50 is formed in a substantially V shape, but the present disclosure is not limited to this. For example, the cover stopper 50 may be formed in another shape such as an inverted triangular shape.

In the above embodiment, the rotation guide 51 is formed in an L shape, but the present disclosure is not limited to this, as long as the rotation guide 51 has such a shape that the rib engagement surface 42*a* can slide in the front-rear direction. For example, the rotation guide 51 may be formed in a rectangular shape in a side view.

In the above embodiment, as the conveyance path H of the sheet K, a path is adopted in which the sheet K is sent out from the accommodating portion 11 toward the cover 16, moves on the cover 16, and then is conveyed toward the front. However, the conveyance path H is not limited to the above path as long as the conveyance path H includes a path through which the sheet K moves on the cover 16 (that is, a part of the conveyance path H is defined by the cover 16).

What is claimed is:

1. A conveyance device comprising:

a cover including:

a cover main body having a base end and an opposite end opposite the base end;

a rotation shaft provided at the base end of the cover main body, the cover being configured to move between a closed position at which the cover covers a conveyance path of a sheet and a relay position below the closed position, the cover at the closed position defining a part of the conveyance path, the cover being further configured to rotationally move about the rotation shaft between the relay position and an open position at which the cover opens the conveyance path to outside;

a cover engaging portion provided at the opposite end of the cover main body; and a rib provided closer to the base end than the cover engaging portion is, the rib having a rib engagement surface having an arc shape with a center at the rotation shaft;

a cover stopper configured to engage the cover engaging portion when the cover is located at the closed position and to restrict rotational movement of the cover toward the open position;

a rotation guide configured to contact, from above, the rib engagement surface during rotational movement of the cover and to guide rotational movement of the cover between the open position and the relay position; and an urging member configured to urge the cover from the relay position toward the closed position, the conveyance device being configured such that:

when the cover rotationally moves from the open position to the relay position, the rib and the rotation guide engage each other to restrict upward movement of the cover against an urging force of the urging member; and when the cover reaches the relay position from the open position, the rib and the rotation guide become disengaged and the cover moves to the closed position where the cover engaging portion and the cover stopper engage each other.

2. The conveyance device according to claim 1, wherein the arc shape of the rib engagement surface has a constant radius with the center at the rotation shaft.

3. The conveyance device according to claim 2, wherein the rib includes a protruding portion configured to protrude toward the rotation guide in a state where the cover is located at the closed position, the protruding portion being located at an end of the rib engagement surface in a rearward direction in which the cover moves from the relay position to the open position.

4. The conveyance device according to claim 1, wherein the urging member includes a spring and a lifter, the lifter being configured to receive the urging force of the spring and to press the rotation shaft; and wherein an upper surface of the lifter is inclined so as to press the rotation shaft upward and in a forward direction in which the cover moves from the open position to the relay position.

5. The conveyance device according to claim 4, wherein the lifter includes:

a contact surface configured to contact the spring; and a spring positioning portion configured to position the spring in such a posture that an urging direction of the spring is perpendicular to the contact surface.

6. The conveyance device according to claim 1, wherein, when the cover moves from the closed position to the relay position, the rib and the rotation guide engage each other after the cover engaging portion is disengaged from the cover stopper.

7. The conveyance device according to claim 1, wherein at least part of the rotation guide overlaps the urging member in a plan view.

8. The conveyance device according to claim 1, further comprising a tray configured to accommodate a sheet, wherein the rib further includes an interference avoiding portion connecting to the rib engagement surface, the interference avoiding portion having at least two surfaces having different gradients so as to avoid interference with the tray in a state where the cover is located at the closed position.

9. The conveyance device according to claim 1, further comprising a support member to which the cover is assembled such that the cover is rotatably moved about the rotation shaft, wherein the cover includes an inclined portion that is inclined in a direction toward a center in a rotational axis direction of the cover toward a rearward direction in which the cover moves from the relay position to the open position.

10. The conveyance device according to claim 9, wherein the support member includes a support guide configured to guide movement of the cover between the closed position and the relay position; and wherein the urging member is located at a lower portion of the support guide.

11. The conveyance device according to claim 9, wherein the support member is formed with a cutout portion at an upper part thereof, the cutout portion being spaced from the cover in a forward direction in which the cover moves from the open position toward the relay position; and wherein the cover includes a covering portion configured to cover the cutout portion from rearward in a state where the cover is located at the closed position.

12. The conveyance device according to claim 10, wherein the support member further includes a spring support configured to support the spring; and wherein the spring support and the support guide are integrally molded.

13. The conveyance device according to claim 1, further comprising a path forming member defining the conveyance path together with the cover, at least part of the path forming member being located below the cover, wherein the cover includes a plurality of sheet passage ribs configured to be contacted by the sheet that is conveyed, the plurality of sheet passage ribs being provided on a surface of the cover facing the conveyance path;

wherein the conveyance device further comprises a restricting portion configured to contact the cover when the cover moves down from the closed position to the relay position and to restrict downward movement of the cover of a particular amount or more; and wherein, in a state where the cover is in contact with the restricting portion, the plurality of sheet passage ribs is located at higher positions than the path forming member.

14. The conveyance device according to claim 13, wherein the restricting portion is formed in an arc shape so as to, when the cover rotationally moves from the relay position to the open position, restrict downward movement of the cover until the plurality of sheet passage ribs separates from the path forming member in a rearward direction in which the cover moves from the relay position to the open position.

15. The conveyance device according to claim 13, wherein the restricting portion is provided at a position outside the conveyance path.

16. The conveyance device according to claim 1, wherein a guide flap configured to define a part of the conveyance path is provided at an upper part of the cover; and wherein the cover includes a protection rib having an upper end that is located at a higher position than at least part of the guide flap in a state where the cover is located at the closed position.

17. The conveyance device according to claim 16, further comprising an upper tray located above the cover and configured to accommodate a sheet, wherein an upper end of the protection rib is located at a higher position than a lower end of the upper tray in a state where the cover is located at the closed position.

18. The conveyance device according to claim 1, wherein a cushioning member is provided at an upper end of the cover.

19. The conveyance device according to claim 1, wherein the cover engaging portion has an inclined or rounded surface configured to engage the cover stopper, the inclined or rounded surface being located at an end of the cover engaging portion in a rearward direction in which the cover moves from the relay position to the open position.

* * * * *